United States Patent [19]

Gropper et al.

[11] 4,098,457

[45] Jul. 4, 1978

[54] FRICTION PRODUCING STATOR PAD FOR AN AIR DRIVEN CENTRIFUGE

[75] Inventors: Lee Gropper, Los Altos Hills; Kenzo Ishimaru, San Jose, both of Calif.

[73] Assignee: Beckman Instruments, Inc., Fullerton, Calif.

[21] Appl. No.: 781,915

[22] Filed: Mar. 28, 1977

[51] Int. Cl.[2] ..... B04B 9/12

[52] U.S. Cl. ..... 233/23 R; 233/1 C

[58] Field of Search ..... 233/1 C, 23 A, 23 R, 233/24, 1 R; 308/9; 310/10

[56] References Cited

U.S. PATENT DOCUMENTS

| | | | |
|---|---|---|---|
| 2,213,107 | 8/1940 | McBain | 233/23 R |
| 3,456,875 | 7/1969 | Hein | 233/24 |
| 3,747,841 | 7/1973 | Ross | 233/24 |
| 3,780,937 | 12/1973 | Tahara et al. | 233/24 |
| 3,958,753 | 5/1976 | Durland et al. | 233/1 C |

*Primary Examiner*—George H. Krizmanich
*Attorney, Agent, or Firm*—R. J. Steinmeyer; F. L. Mehlhoff; W. H. May

[57] ABSTRACT

An air driven centrifuge which utilizes a stator with a floating stator pad for alleviating excessive vibration of the rotor associated with critical rotating speeds. The floating stator pad incorporates means for increasing the friction between the pad and the stator in order to increase the ability of the stator pad to provide greater dampening of the rotor for improving the smoothness and stability of its operation.

8 Claims, 6 Drawing Figures

FRICTION PRODUCING STATOR PAD FOR AN AIR DRIVEN CENTRIFUGE

BACKGROUND OF THE INVENTION

This invention relates to air driven centrifuges and more particularly is directed to means incorporated within the rotor seat of the centrifuge to increase the dampening of any excessive vibration or fluttering of the rotor during certain critical speeds of rotation.

It has been determined in the past that air driven centrifuges provide significant advantages in producing ultra high speed centrifugation. Certain fluid mixtures require extremely high rotational speeds for separation. One example of such a requirement is with respect to the separation of materials in blood such as protein which require extremely high speeds. Other processes which require these very high speeds of rotation are the separation of minute viruses such as rubella, the concentration of viruses from clinical specimens, the concentration of immunoglobulins from urine, saliva and bronchial washings, and quantitative electron microscopy such as particle coating.

In addition, air driven centrifuges provide unique advantages in that there are no bearings requiring lubrication, since the rotor rides on a cushion of air. Since there are no contacting parts with respect to rotation of the rotor, there is no wearing of mechanical parts. It has been found that there is extreme stability at high speeds and that these high speeds can be obtained without accompanying excessive heat.

Since it is impossible to mechanically construct a rotor and its associated components in a centrifuge with such precise accuracy that it would be one hundred percent in balance, a certain amount of imbalance may be caused by slight imperfections in the rotor that may exist either in the threads or flutes on the rotor, for example, or possibly in the orientation or operation of the air jets. Consequently, during certain critical rotating speeds these imperfections may accumulate to the point that the rotor may be subjected to excessive vibration or wobbling which could cause the rotor to become dislodged from its rotor seat and thrash around within the centrifuge.

Prior art approaches have been developed for helping to attenuate the problem of any deliterious vibration. One example is the Hein U.S. Pat. No. 3,456,875 which shows the use of a stationary stator having a floating stator pad mounted thereon with a plurality of feet or buttons located on the bottom of the stator pad. During normal operations this floating stator pad provides an ability to alleviate nearly all problems with respect to excessive vibration.

However, it has been determined in practice that the operation of the floating stator pad has not been completely satisfactory, since the rotational operation of the centrifuge has not been as stable and as smooth as desired. In some instances imperfections or other contributing factors in the rotor design or operation may combine to cause the rotor to become dislodged and crash within the centrifuge.

Therefore, it is necessary to provide some type of means for making the stator pad operate more efficiently to create a better dampening of the rotor during its operation to provide the necessary smooth and stable operation which is critical to the successful use of an air driven centrifuge. Otherwise, not only is there a possibility of the rotor thrashing around within the centrifuge and causing damage to the rotor and/or centrifuge, but also the centrifugated constituents of the sample in the rotor will become remixed and ruin the centrifugation run.

SUMMARY OF THE INVENTION

The present invention is directed to means for increasing the amount of resistance or friction between the floating stator pad and the stator. Such increased resistance to the relative movement between the stator pad and the stator contributes significantly to the complete elimination of any undesirable vibration or fluttering which may occur in the rotor during its critical speed operation during centrifugation.

Various approaches may be utilized to create additional resistive forces between the relative movement of the stator and stator pad. The main object of these various approaches is to provide a stator pad which will improve its dampening effect on the rotor to contribute to a smooth and stable operation throughout the various rotating speeds of the rotor during high speed centrifugation.

It has been found that the utilization of this additional resistive or friction force in the stator pad movement with respect to the stator provides an order of magnitude more stability to the operation of the rotor and, therefore, essentially eliminates the deliterious effects of any vibration or fluttering which may occur during operation.

DETAILED DESCRIPTION OF THE INVENTION

Figure 1:
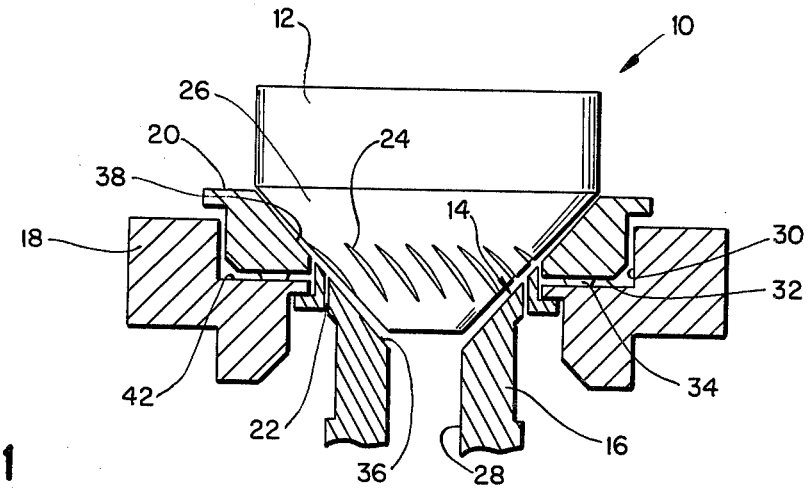
FIG. 1 is a partial sectional elevation view of a centrifuge rotor mounted within the rotor seat.

As set forth in the above-referenced Hein U.S. Pat. No. 3,456,875 patent and as shown in somewhat abbreviated form in FIG. 1, an air driven centrifuge 10 comprises a rotor 12 mounted within a rotor seat 14, having a central core 16, a stator 18 and a stator pad 20. Located in the core 16 are a periphery of air jets 22 which are designed to impinge jets of air on the flutes 24 on the bottom portion 26 of the rotor 12. These air jets 22 provide the means for rotating the rotor 12 at ultra high speeds of centrifugation and also supply the cushion of air upon which the rotor rides above the rotor seat 14. Located in the center of the core 16 is an opening 28 designed to allow venting to the atmospheric air to avoid the creation of a vacuum between the rotor seat and the rotor to prevent the rotor from riding too close to the rotor seat.

It should be noted that the stator has an annular channel 30 which is designed to receive the stator pad 20. Located in spaced relationship along the bottom surface 32 of the stator pad are a plurality of support feet 34. It should be noted that the support surface 36 of the stator central core 16 and the support surface 38 of the stator pad 20 have a generally frustoconical configuration to mate with the frustoconical lower portion 26 of the rotor 12.

Figure 2:
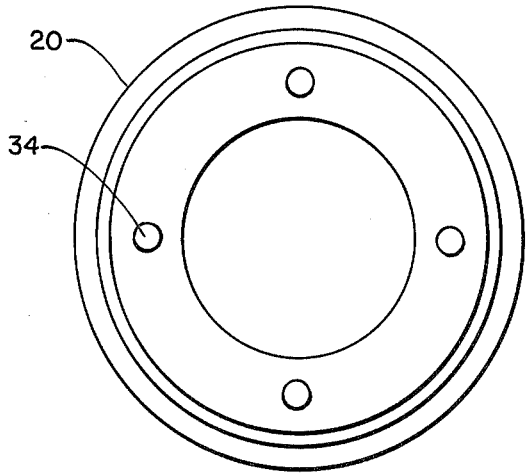
FIG. 2 is a bottom plane view of the stator pad.
Figure 3:
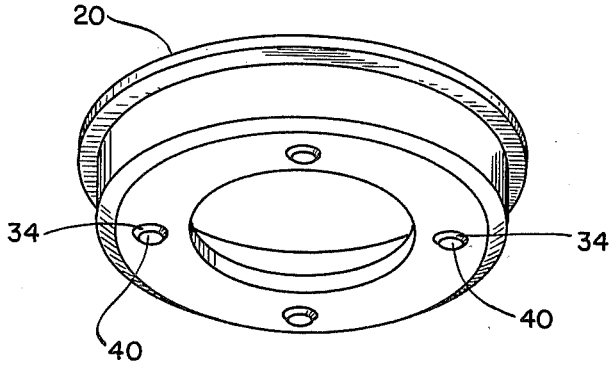
FIG. 3 is a perspective view of a stator pad showing the bottom side of the stator pad with its support feet.

As shown in FIGS. 2 and 3, the stator pad 18 has a plurality of support feet 34 which are designed to support the stator pad 20 within the annular chamber 30 of the stator 18 as shown in FIG. 1.

Figure 4:
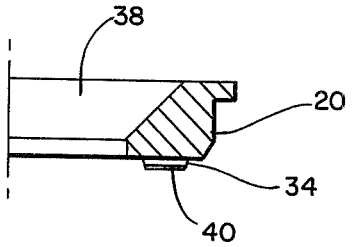
FIG. 4 is a partial sectional view of the stator pad showing one of its support feet with the present invention incorporated.

With respect to FIG. 4, the stator pad 20 has attached to opposite pairs of its support feet 34 a small disk or lining 40 which is designed to contact the bottom surface 42 of the channel 30 in the stator 18 to increase the relative resistive forces between the stator pad and the stator. Although it is preferable to have the additional resistive disk material on the opposite foot on the stator pad as shown in FIG. 3, an additional disk of resistive material could be placed on each and every one of the support feet spaced around the bottom of the stator pad. Although it has been found that the additional disk or lining 40 can preferably be made of vinyl, it is envisioned that any type of friction producing material could be attached to the bottom of the support feet 34 by some type of adhesive. This material would operate satisfactorily to increase the necessary resistive forces between the relative movement of the stator pad and the stator to enhance the dampening effect of the stator pad on the rotor.

Figure 5:
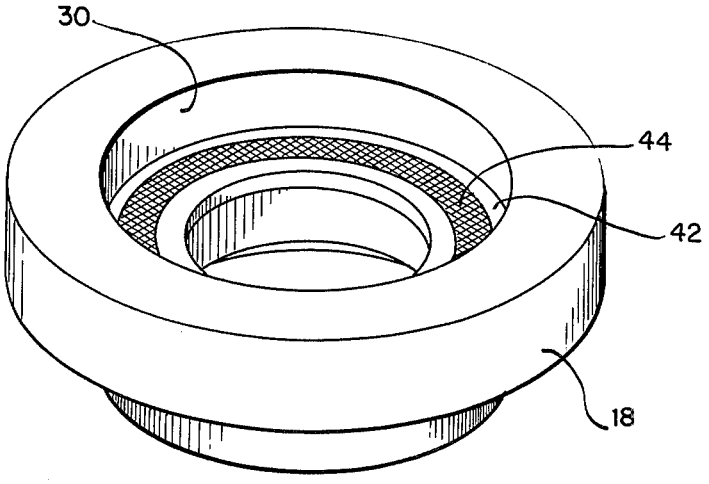
FIG. 5 is a perspective view of the stator with an alternate embodiment of the present invention incorporated.

As an alternative embodiment of the invention in FIG. 5, a ring 44 of resistive type material could be positioned in the bottom 42 of the annular channel 30 in the stator 18. Consequently, the bottom of the support feet 34 would contact the ring 44 of resistive material and provide the added additional resistive forces between the relative movement of the stator pad and the stator and provide the necessary increased dampening of the rotor.

Figure 6:
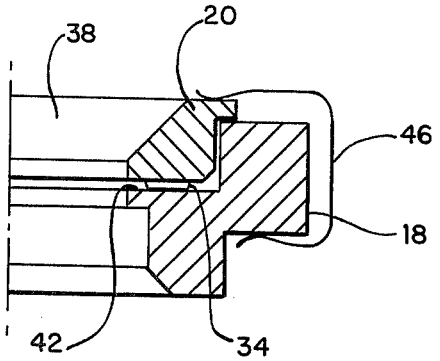
FIG. 6 is a second alternate embodiment of the present invention.

A second embodiment of the present invention is shown in FIG. 6 wherein some type of biasing spring 46 could be attached between the stator pad 20 and the stator 18 to increase the amount of contact between the support feet 34 of the stator pad with the bottom 42 of the stator 18. Consequently, there would be increased friction forces between the stator pad and the stator. It is envisioned that the spring 46 could be of any configuration which would be able to bias the stator pad 20 and the stator 18 against each other.

A third embodiment of the present invention involves the elimination of the feet 34 from the stator pad 20 in FIG. 1 and the addition of a pair of 180° opposed friction disks 40 directly on the flat bottom 32 of the stator pad.

The above discussed aspects of the present invention could be incorporated by the use of adding abrasive materials to the composition of the stator pad when it is being made, so that the contact between the stator pad 20 and the stator 18 would present greater resistive forces.

During the operation of the rotor 12 in FIG. 1 the stator pad 20 is designed to move in both a nutational and precessional manner to act as a buffer for vibrations resulting from rotation of the rotor 12 at slow speeds either during the starting or stopping of the rotor. At high speeds the rotor rests only on a cushion of air and does not touch the stator at any point. The aspect of having the additional disks of friction material 40 as shown in FIGS. 3 and 4 on the stator pad provides for increased resistive forces between the stator pad and the stator, so that the stator pad may absorb more vibrations of the rotor and avoid these vibrations being transferred to the stationary stator during critical speed of rotation.

Similar results will occur through the utilization of the additional resistive ring 44 of material in FIG. 5 or the utilization of the biasing spring 46 in FIG. 6. In addition, if the stator pad 20 is made of a material which contains a significant amount of abrasive material incorporated therein, the friction forces between the stator pad and the stator will increase to provide the necessary additional dampening necessary to completely eliminate the transmission of any undesirable or deliterious vibrations from the rotor to the stationary stator 18.

What is claimed is:

1. A centrifuge rotor seat for an air driven centrifuge rotor, said seat comprising:

a stator mounted within said centrifuge, said stator having a generally cylindrical central portion and an upper annular flanged portion extending outward from said central portion;

a stator pad movably positioned on said annular flanged portion of said stator; and means attached to the bottom of said pad for increasing friction forces between said stator pad and said stator during relative movement between said stator and said stator pad so that said increased friction forces between said stator and said pad with said friction increasing means will provide greater stability to said air driven centrifuge rotor during its operation than the friction forces generated between said stator and said bottom of said pad.

2. A centrifuge rotor seat as defined in claim 1, wherein said friction increasing means comprises a plurality of friction producing disks positioned around the lower circumferential surface of said stator pad.

3. A centrifuge rotor seat as defined in claim 2, wherein said stator pad has a plurality of feet and one of said plurality of said disks is attached to each of said feet.

4. A centrifuge rotor seat as defined in claim 1, wherein said friction increasing means comprises a plurality of friction producing disks positioned on said stator below said stator pad.

5. A centrifuge rotor seat as defined in claim 1, wherein said friction increasing means comprises a separate annular ring of friction producing material located between said stator and said stator pad.

6. A centrifuge rotor seat for an air driven centrifuge rotor, said seat comprising:

a stator mounted within said centrifuge, said stator having a generally cylindrical central portion and an upper annular flanged portion extending outward from said central portion;

a stator pad movably positioned on said annular flanged portion of said stator;

means positioned between said pad and said stator for increasing friction forces between said stator pad and said stator during relative movement between said stator and said stator pad to provide increased stability to said air driven centrifuge rotor during its operation; and a spring biased member mounted adjacent said stator and stator pad to bias said stator pad in closer contact with said stator.

7. An air driven centrifuge comprising:

a rotor;

means for driving said rotor;

a stator forming a seat for receipt of said rotor;

a circular stator pad movably positioned on said stator, said stator pad moving in response to nutational and precessional movement of said rotor to provide dampening of the rotor during its operation; and means attached to the bottom of said stator pad for making the friction forces between said stator pad and said stator greater than the friction forces generated between said stator and said bottom of said pad to increase the dampening of said rotor and increase the stability of said rotor during operation.

8. An air driven centrifuge as defined in claim 7, wherein said friction increasing means comprises a plurality of disks of friction producing material mounted on said stator pad.

* * * * *